United States Patent [19]

Jeschke et al.

[11] Patent Number: 4,667,952

[45] Date of Patent: May 26, 1987

[54] GUIDING DRUM FOR SHEET-FED PRINTING MACHINES, ESPECIALLY FOR CARDBOARD

[75] Inventors: Willi Jeschke, Heidelberg; Willi Becker, Bammental, both of Fed. Rep. of Germany

[73] Assignee: Heidelberger Druckmaschinen AG, Heidelberg, Fed. Rep. of Germany

[21] Appl. No.: 762,693

[22] Filed: Aug. 5, 1985

[30] Foreign Application Priority Data

Aug. 3, 1984 [DE] Fed. Rep. of Germany ..... 3428668

[51] Int. Cl.[4] ..... B65H 5/12

[52] U.S. Cl. ..... 271/277; 101/410; 271/82

[58] Field of Search ..... 271/206, 82, 277; 101/410, 409

[56] References Cited

U.S. PATENT DOCUMENTS

| | | | |
|---|---|---|---|
| 3,534,683 | 10/1970 | Barthel | 271/82 X |
| 3,865,362 | 2/1975 | Luffy | 271/82 |
| 4,334,473 | 6/1982 | Becker | 271/277 X |

*Primary Examiner*—Richard A. Schacher

*Attorney, Agent, or Firm*—Herbert L. Lerner; Laurence A. Greenberg

[57] ABSTRACT

Sheet-guiding drum for sheet-fed rotary printing machines, having a drum body carrying at least two gripper bridges adjustable to different paper thicknesses, includes gripper supports carried by the drum, the gripper supports being adjustable in at least substantially radial direction of the drum; play-free adjusting elements carried by the drum body and adjustable independently of one another for adjusting the gripper supports; and a central adjusting device mounted readily accessibly on the drum body for actuating the adjusting elements in common.

13 Claims, 10 Drawing Figures

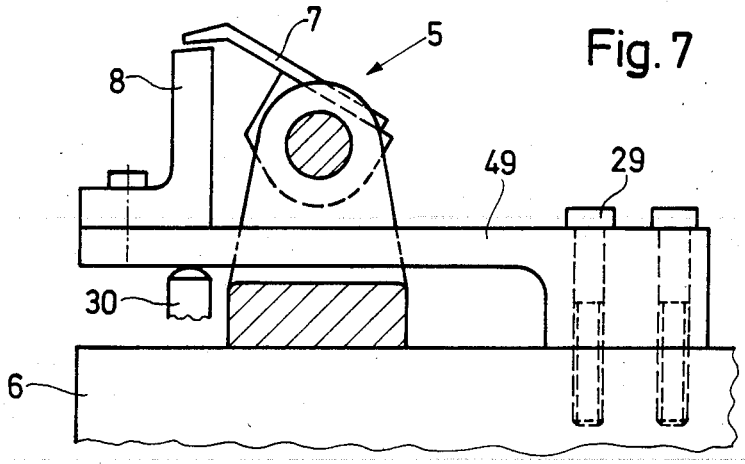
Fig. 7
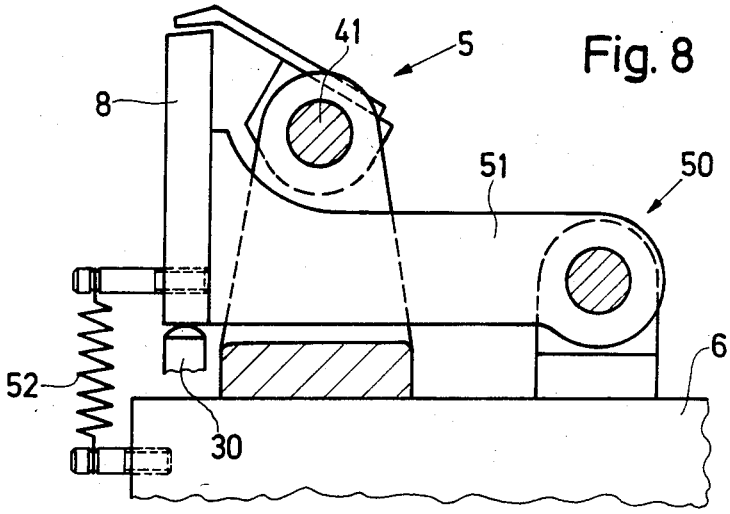
Fig. 8
Fig. 9
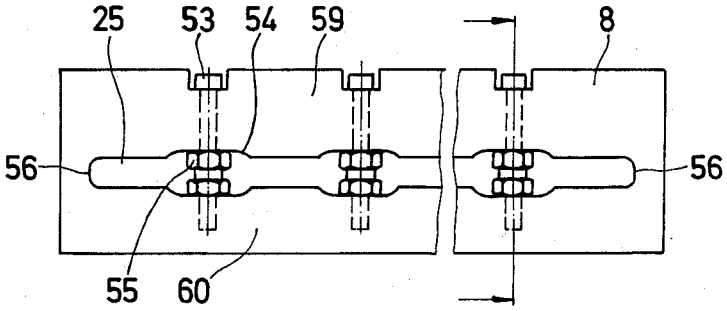
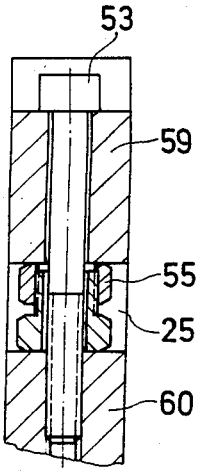
Fig. 10

GUIDING DRUM FOR SHEET-FED PRINTING MACHINES, ESPECIALLY FOR CARDBOARD

The invention refers to a sheet-guiding drum for sheet-fed printing machines, in particular for cardboard-fed machines, with at least two gripper bridges which can be adjusted to different paper thicknesses.

From the Japanese patent disclosure No. Sho 57-174263 (1982). A device has become known for raising and lowering the gripper support of a gripper bridge for a sheet-guiding cylinder. The gripper support is set to the thickness of the paper to be processed, by means of an adjusting rod which is arranged so that it can be shifted in axial direction of the cylinder by means of a screw against the force of a spring directly below the gripper support which extends over the entire length of the cylinder. Because the contact surfaces of the gripper support and adjusting rods extend conically opposite one another in longitudinal direction of the cylinder, a shifting of the adjusting rod results in radial movement of the gripper support in a vertical direction.

Although this heretofore known device does permit common adjustment of all the individual gripper supports on a gripper bridge, the alignment of the individual gripper supports with respect to one another cannot, however, be implemented.

In the case of cardboard-fed machines, it is known to be advantageous for a sheet conveyor that the sheet-guiding cylinders and drums have a relatively large diameter; for example, in the case of offset machines, double the diameter of the plate and blanket cylinders. A gripper bridge must be provided for each sheet-guiding surface of a cylinder or a sheet-guiding drum. Consequently, sheet-guiding drums of double diameter have two gripper bridges, and drums of triple diameter have three gripper bridges. In arrangements of more than one gripper bridge on a cylinder or a sheet-guiding drum, however, slight processing errors such as center offset or non-linearity of the individual gripper supports with respect to one another have a particularly adverse effect on the register. Furthermore, it is time-consuming to adjust individually the gripper support of several gripper bridges to the thickness of the paper or cardboard to be processed. This also means that the gripper supports of a guiding drum must be set exactly at the same height, a task involving considerable difficulties.

It is accordingly an object of the invention, therefore, to adjust in common the gripper support of all the gripper bridges of a guiding drum of the type described in the introduction hereto without restricting the possibility of individually adjusting at least several groups of individual gripper supports with respect to one another.

With the foregoing and other objects in view, there is provided, in accordance with the invention, a sheet-guiding drum for sheet-fed rotary printing machines, having a drum body carrying at least two gripper bridges adjustable to different paper thicknesses, includes gripper supports carried by the drum, the gripper supports being adjustable in at least substantially radial direction of the drum; play-free adjusting elements carried by the drum body and adjustable independently of one another for adjusting the gripper supports; and a central adjusting device mounted readily accessibly on the drum body for actuating the adjusting elements in common. Common adjustment of all the gripper supports of a sheet-guiding drum by means of one single central adjusting device shortens the set-up time and simplifies handling. A sheet-guiding drum with several individually adjustable gripper bridges would have to be pin-pointed into the individual positions in which each gripper bridge would be accessible. This pin-pointing by itself would already be extremely time consuming. Equal height of all the individual gripper supports i.e. all support surfaces are on one plane, as well as freedom of play with regard to the control elements is ensured in each height setting. Slight inaccuracies in production and installation can be taken into consideration by the adjustment facilities which are provided, thereby ensuring uniform register for all printings of an edition despite having several gripper bridges on one sheet-guiding drum. If several guiding drums according to the invention are provided in a printing machine, they can then be installed in such a way that the control units of all the guiding drums are accessible in a given position of all of the cylinders.

In accordance with a further feature of the invention of the instant application, the gripper supports are radially adjustably held on the gripper bridges.

In accordance with another feature of the invention of the instant application, the gripper supports are arranged on a spring beam.

In accordance with an added feature of the invention of the instant application, there is provided a shaft disposed on the drum and extending in axial direction thereof parallel to the rotational axis of the drum, the gripper supports being mounted on and swingable about the shaft.

In accordance with an additional feature of the invention of the instant application, there are provided two adjusting discs respectively disposed at end faces of the drum, and respective control arms connecting the adjusting discs and gripper supports, respectively, the gripper supports being adjustable by the adjusting discs in conjunction with the control arms.

In accordance with yet a further feature of the invention of the instant application, the central adjusting device is disposed in a middle region of one of the gripper bridges, and including an adjusting shaft mounted on the drum and carrying respective adjusting pinions operatively engaging the adjusting discs, the adjusting shaft further carrying a worm drive in operative engagement with the central adjusting device, the adjusting discs being actuatable by the central adjusting device via the worm drive, the adjusting shaft and the adjusting pinions.

In accordance with yet another feature of the invention of the instant application, each of the control arms is adjustable in length.

In accordance with yet an added feature of the invention of the instant application, each of the gripper supports is constructed as a resilient clamping beam formed with a slot extending in longitudinal direction thereof and dividing the clamping beam into a thin flexible clamping rail and a rigid gripper support carrier, the gripper support being fastened by bolts to the drum body in a middle region of the clamping rail.

In accordance with yet an additional feature of the invention of the instant application, the central adjusting device is disposed at one of the end faces of the drum body, and including cam-bearing adjusting discs disposed at the end faces of the drum body and mutually connected by cross-pieces, the adjusting discs being actuatable by the central adjusting device via a worm drive, the cams of the adjusting discs being operatively engageable with ends of adjusting bolts threadedly received in both end regions of the gripper support.

In accordance with again another feature of the invention of the instant application, the gripper supports are swingably mounted and are adjustable against spring bias by means of adjusting bolts.

In accordance with again an added feature of the invention of the instant application, the gripper supports are swingable about a bearing mounted on the drum body and disposed behind a gripper-carrying shaft of a respective gripper bridge, the bearing having a rotary axis extending parallel to the gripper-carrying shaft.

In accordance with again an additional feature of the invention of the instant application, the gripper supports is formed as a beam having a longitudinal slot therein separating an upper beam member from a lower beam member, a plurality of clamping bolts mutually connecting the upper and the lower beam members across the slot and cooperating with double clamping nuts mounted on the clamping bolts and disposed in the slot for aligning the respective gripper support.

In accordance with a concomitant feature of the invention of the instant application, there is provided motor means connected to the central adjusting device for driving the device, and a control panel connected to the central adjusting device for controlling the central adjusting device.

Other features which are considered as characteristic for the invention are set forth in the appended claims.

Although the invention is illustrated and described herein as embodied in guiding drum for sheet-fed printing machines, especially for cardboard, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which:

FIG. 7 is an enlarged fragmentary view of any one of FIGS. 1, 3 and 5 showing a modified gripper support which is spring-mounted;

FIG. 8 is a view similar to that of FIG. 7 showing another embodiment of a gripper support which is pivot-mounted;

FIG. 9 is a fragmentary view of FIG. 4 showing modified gripper supports constructed as an adjustable double beam; and FIG. 10 is an enlarged cross-sectional view of FIG. 9 taken along the line X—X showing one of the gripper supports.

Figure 1:
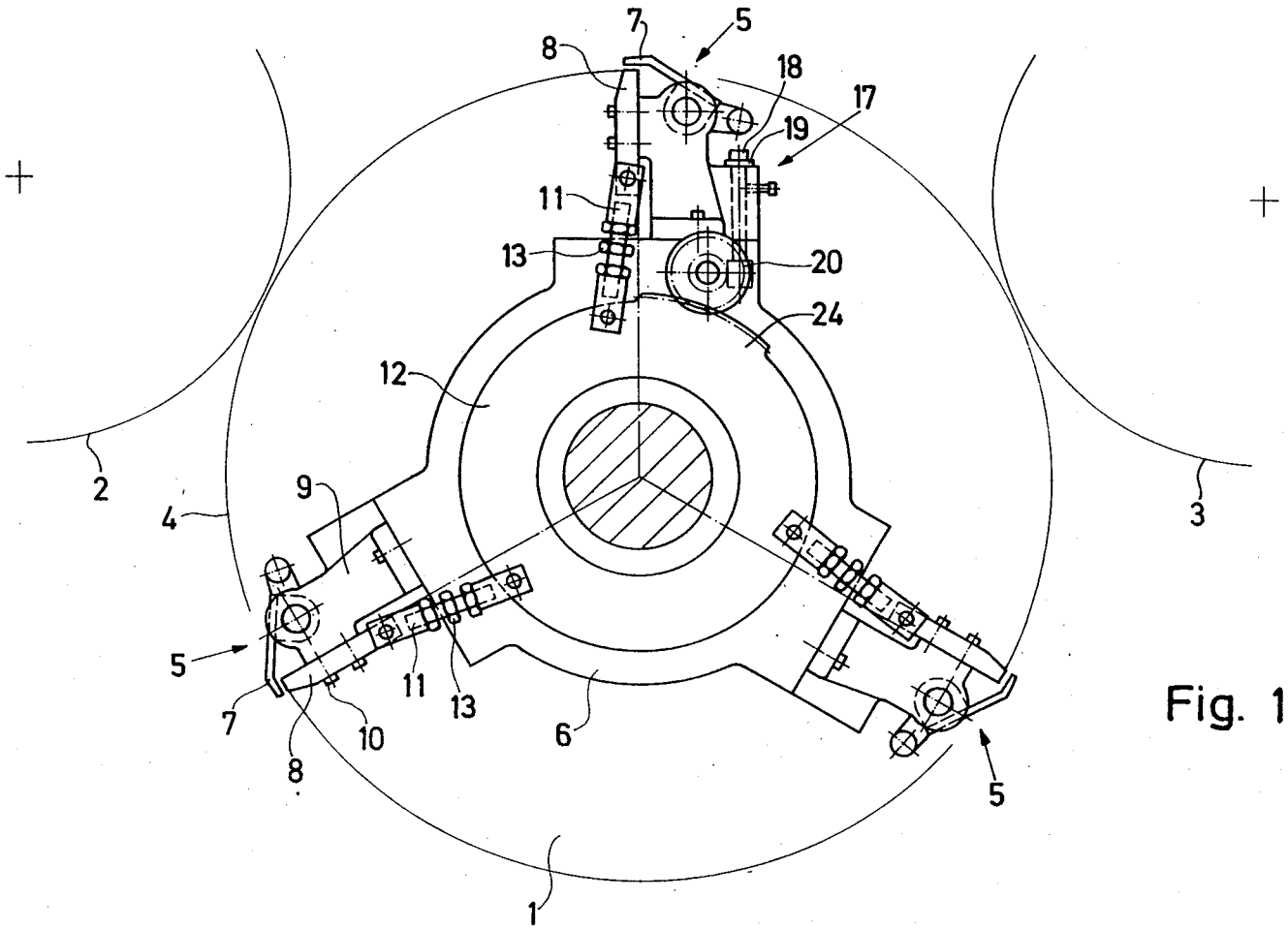
FIG. 1 is a diagrammatic end view of a guiding drum according to the invention having three gripper bridges.

Referring now to the drawing and first, particularly to FIG. 1 thereof, there is shown a guiding drum 1 which takes over a printed sheet from an impression cylinder 2 of a preceding printing unit and transfer it to an impression cylinder 3 of a succeeding printing unit. To achieve a reliable in-register transport not only of sheets but also of so-called cardboard, the guiding drum 1 has a diameter which is three times as great as that of the non-illustrated printing-unit cylinders, such as the plate and blanket cylinder. The ratio of the diameter of impression cylinders 2 and 3 to that of the guiding drum 1 is 2 to 3. Correspondingly, the guiding drum 1 has three sheet-bearing surfaces 4. A gripper bridge 5 is provided at the beginning of each sheet bearing surface 4. These gripper bridges 5 are thus arranged symmetrically distributed on the circumference of the guiding drum 1. They are secured to the drum body 6. The grippers 7 of the gripper bridge 5 operate together with a gripper support 8 extending continuously across the guiding drum 1 on which an individual gripper support member 32, also known as a support block, is provided for each gripper 7. The gripper support 8 is mounted on a gripper bridge bracket 9 by means of bolts 10 so that it can be adjusted in radial direction. The gripper support 8 is articulatingly linked to an adjusting disc 12 via a control arm or driver 11.

The articulation of the control arm 11 with respect to the adjusting disc 12 is such that, by turning the adjusting disc 12, the gripper support 8 is shifted in a radial direction in accordance with the toggle-lever principle.

The control arm 11 is provided with adjusting elements 13 which permit the length of the control arm 11 to be varied, thereby providing individual adjustment of the gripper support. The control arm 11 engage the face end of the gripper support 8. Correspondingly, a respective adjusting disc 12 is provided also on a shaft shoulder 14 at each end of the guide drum 1. The control arms 11 are thus located between the side wall 15 of the machine and the end wall 16 of the drum 1. All joints must, of course, be set without play.

Figure 2:
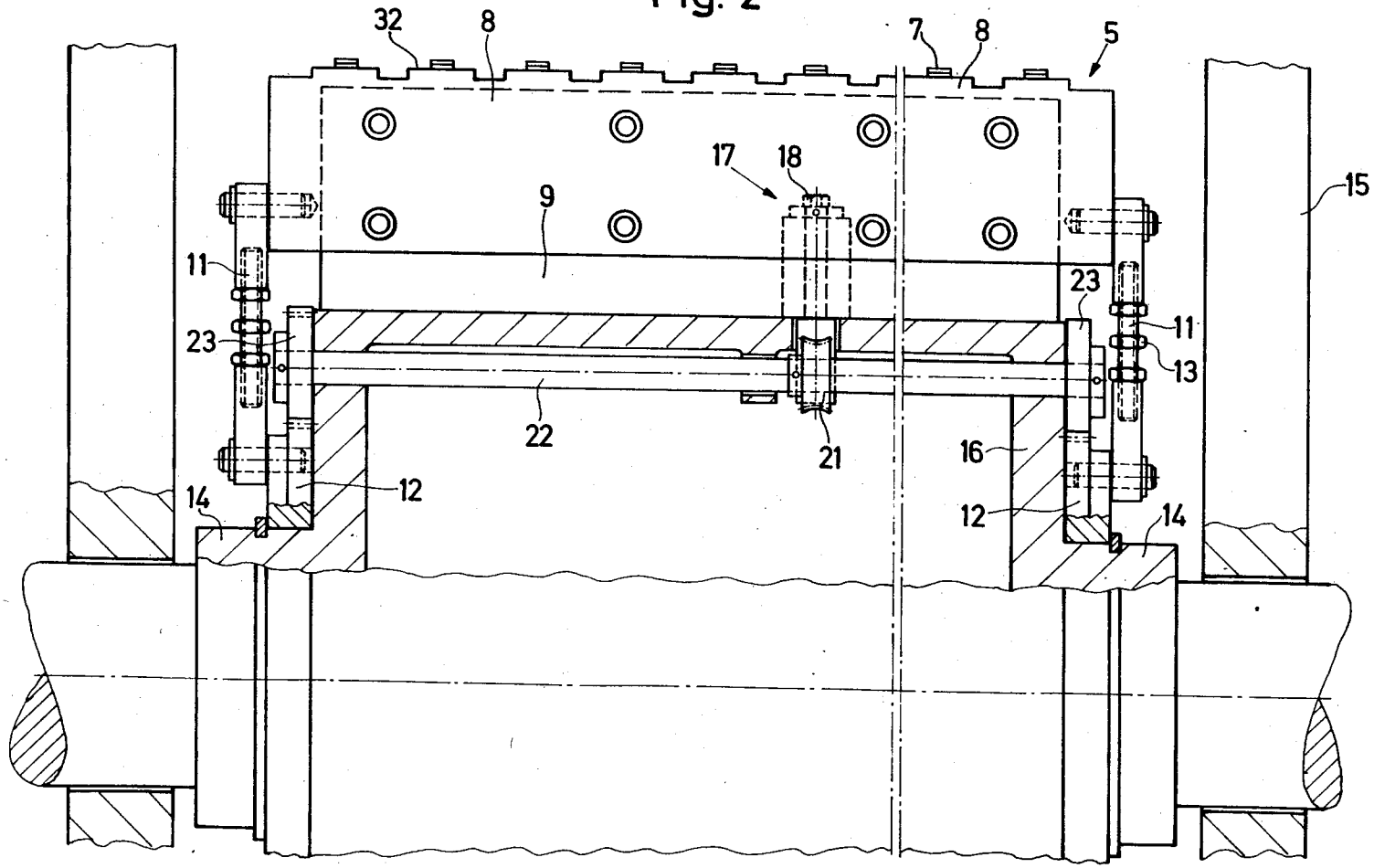
FIG. 2 is a longitudinal sectional view of the guiding drum according to FIG. 1.

A central adjusting device 17 is provided which is readily accessible to one of the three gripper bridges 5. It is formed of a hexagonal adjusting screw 18 with a scale 19 and a worm 20 which is mounted at the lower free end of the hexagonal adjusting screw 18. As shown especially in FIG. 2, a worm gear 21 which interacts with the worm screw 20 is located on an adjusting shaft 22 which is rotatably mounted in the end walls 16 of the guide drum 1. A respective adjusting pinion 23, which engages in a gear rim or crown section 24 provided on the periphery of the adjusting discs 12, is secured to the respective free end of the adjusting shaft 22 projecting from the end wall 16.

By turning the hexagonal screw 18 with the aid of a tool, each of the three gripper supports 8 can be varied simultaneously to a given extent via the worm drive 20, 21, the adjusting shaft 22, the adjusting pinion 23, the adjusting disc 12 and control arm or driver 11. The set height can be read off the scale 19. Due to the play-free setting and the possibility of adjusting each gripper support 8 individually, precise vertical i.e. height or depth, adjustment of all three gripper supports 8 occurs simultaneously to precisely the same extent. The gripper supports 8 are also adjusted linearly.

Figure 3:
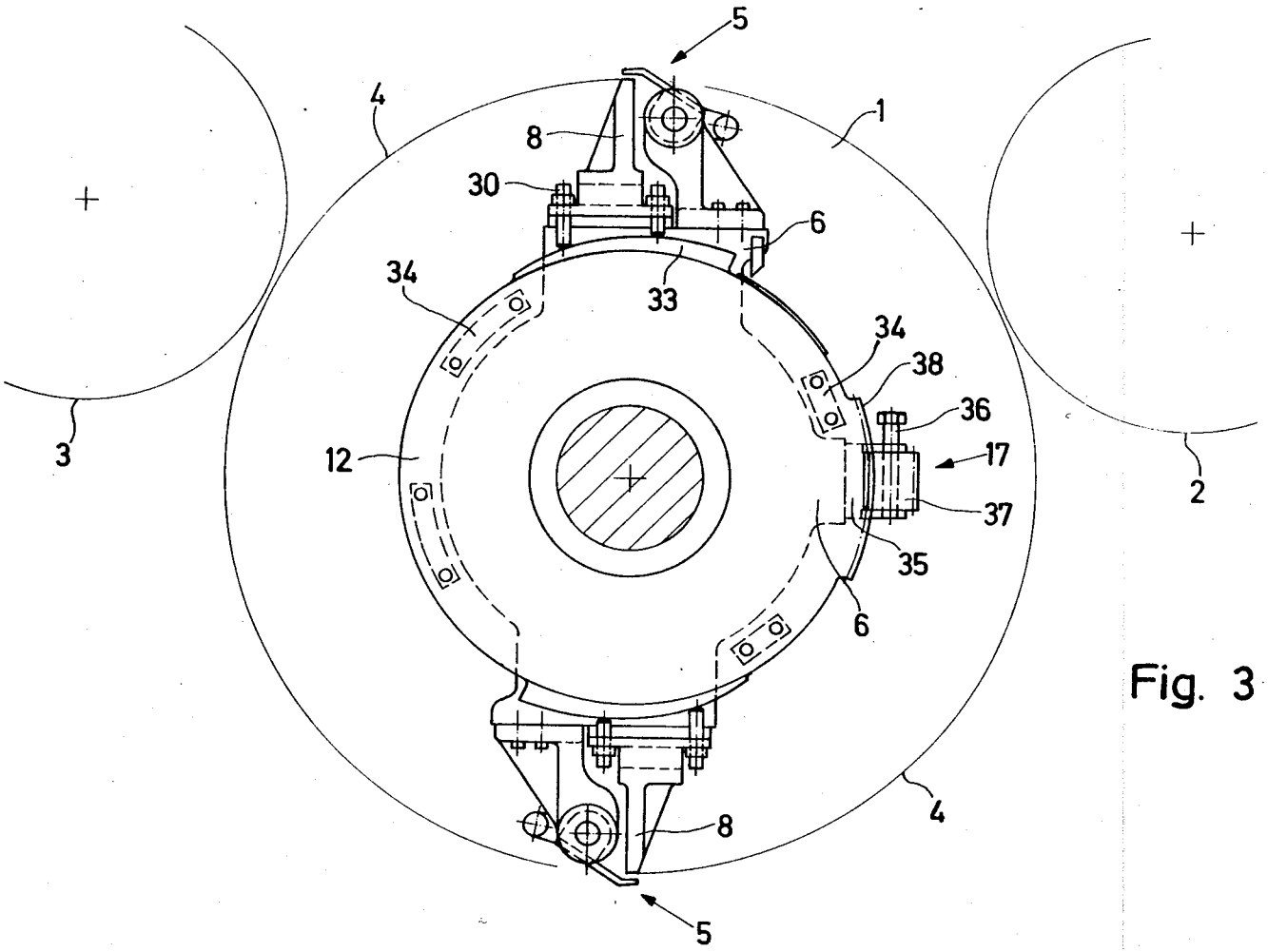
FIG. 3 is a view similar to that of FIG. 1 of a guiding drum according to the invention having two gripper bridges.
Figure 4:
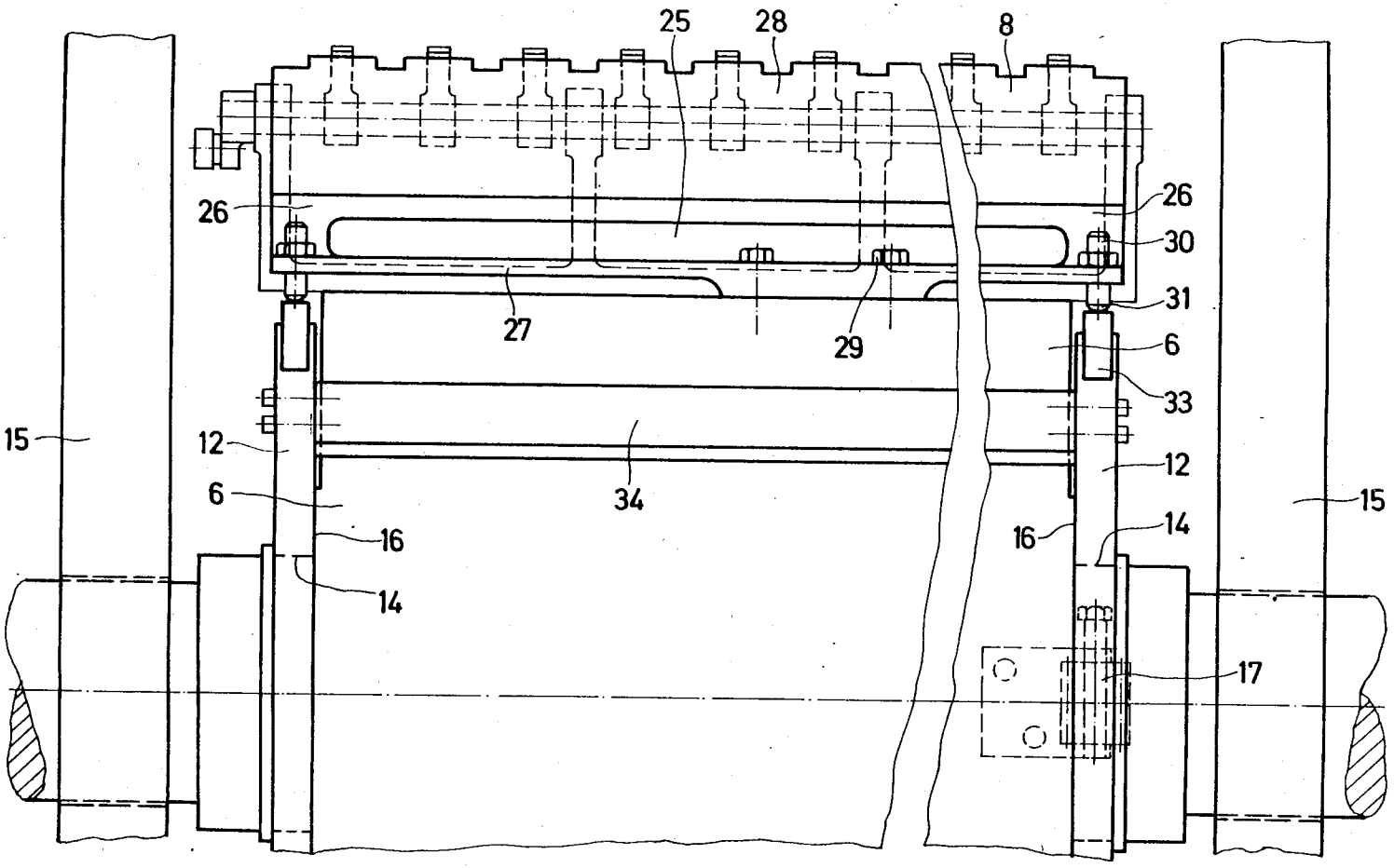
FIG. 4 is a longitudinal or side view of the guiding drum of FIG. 3.

The embodiment of the invention shown in FIG. 3 is a guide drum 1 with only two gripper bridges. This is because the guide drum 1 is twice the diameter of the adjacent impression cylinders 2 and 3. The two gripper bridges 5 are disposed diametrically opposite one another. They are arranged, respectively, at the beginning of each sheet bearing surface 4. As shown especially in FIG. 4, the gripper support 8 is constructed as a resilient or flexible tension beam. It is formed with a longitudinal slot 25 which leaves only a respective narrow web 26 at the ends of the gripper support 8. The slot 25 divides the gripper support 8 in its longitudinal direction into a resilient clamping or tension rail 27 and a rigid gripper support bracket 28. In a middle region thereof, the clamping rail 27 is secured by means of bolts 29 to the drum body 6. In this way, the entire gripper support 8 is connected to the drum body 6 exclusively by the bolts 29.

Two adjusting bolts 30 are screwed into threaded holes formed in the clamping rail 27 at the two ends of the gripper support 8 at the level of the web 26. The respective lower ends 31 of these adjusting bolts 30 are supported on control cams 33. Each control cam 33 is secured to an adjusting disc 12 which is, in turn, rotatably mounted on a shaft shoulder 14 between the drum wall 16 and the machine side-wall 15. The two adjusting discs 12 are mutually connected stably and fixed against relative rotation between one another by means of a traverse or cross piece 34. The central adjusting device 17 is secured to one of the two end walls 16 of the drum body 6. It has a bearing block 35 in which an adjusting worm 37 is mounted by means of an adjusting screw 36. The worm 37 is in meshing engagement with a gear rim or ring gear 38 which is mounted on the corresponding adjusting disc 12 and is constructed as a worm gear.

By turning the adjusting screw 36 with the aid of a wrench, both adjusting discs 12 are turned either in a clockwise or counterclockwise direction by means of the worm screw 37 and worm ring gear 38. Correspondingly, the cams 33 which are secured on the periphery of the adjusting discs 12 are also turned. Due to the pitch of these cams 33, which, for example, can follow an archimedes spiral, the adjusting screws 30 are moved radially upwards or downwards. The clamping rail 37 of the gripper support 8 bends correspondingly. The rigid gripper support bracket 28 remain practically uneffected by this slight bending procedure and only drifts or travels slightly up or down in vertical direction. This clamping procedure thus provides the vertical adjustment of the gripper supports 8 of both gripper bridges 5. Because the adjusting screws 30 are, moreover, individually adjustable, the gripper-bridge halves can be adjusted in such a way that the gripper support 8 extends linearly. In addition, all adjusting elements can be set and mounted, respectively, free of any play.

Figure 5:
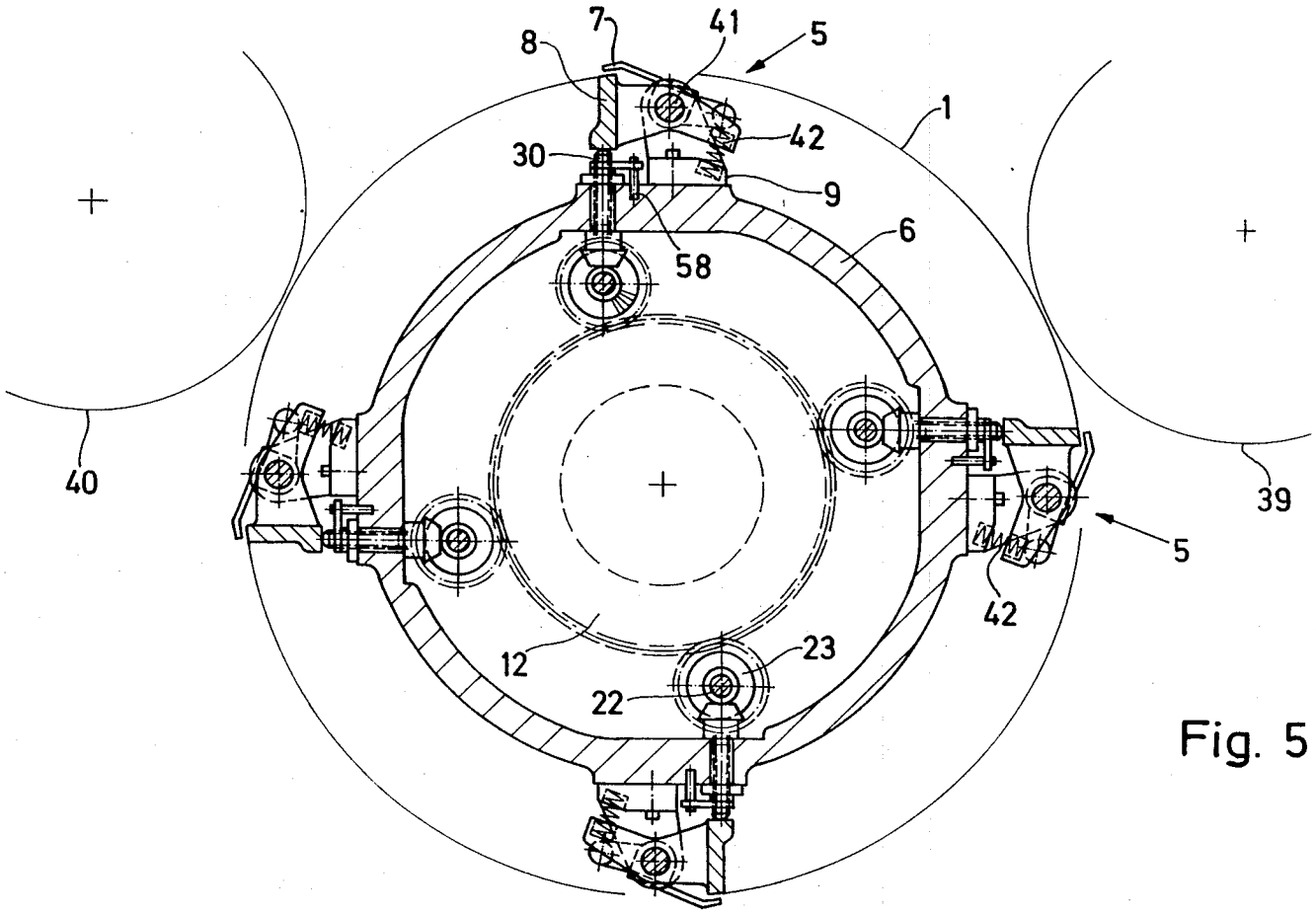
FIG. 5 is a view similar to that of FIG. 1 of a guiding drum with four gripper bridges.
Figure 6:
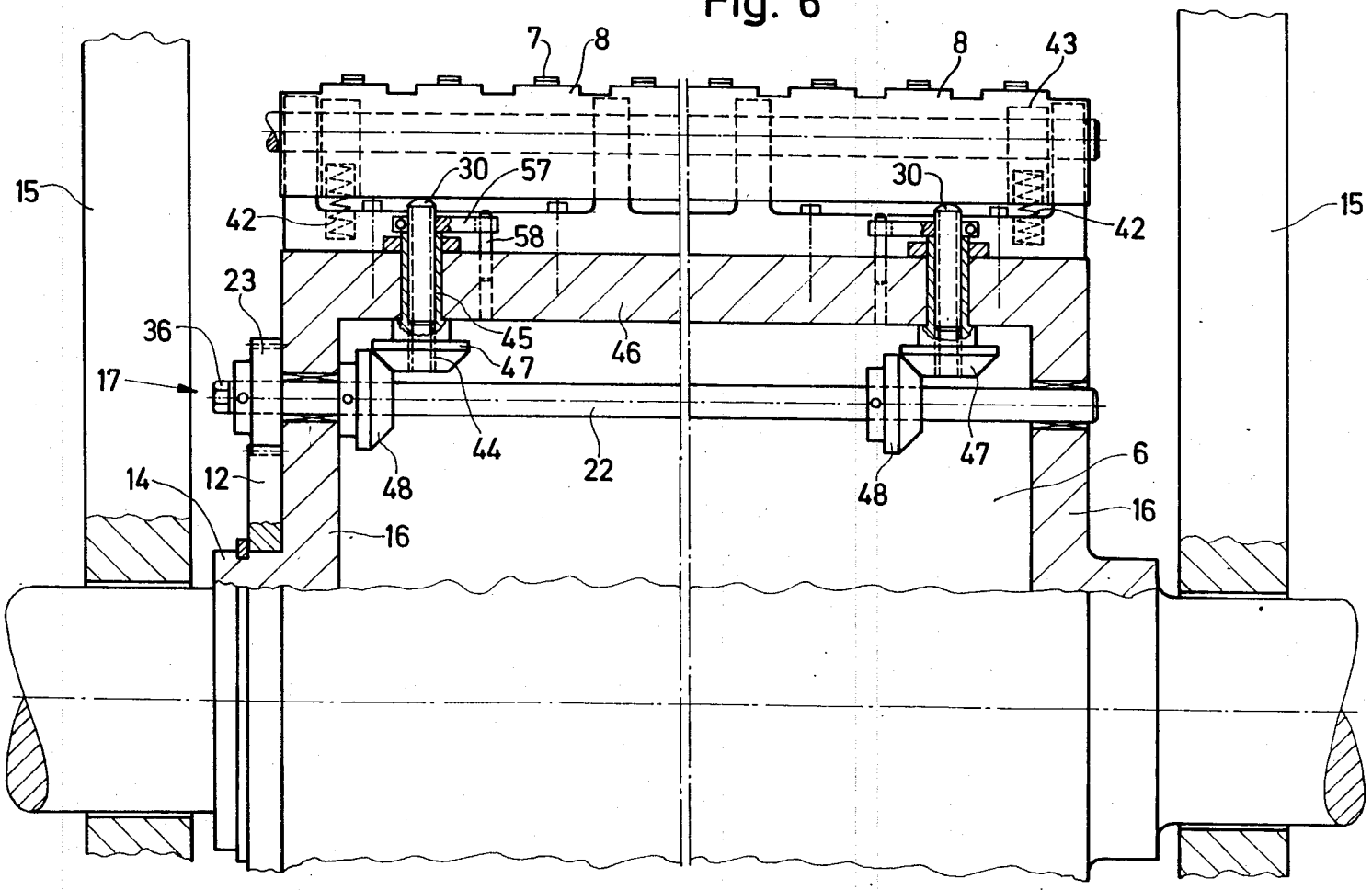
FIG. 6 is a longitudinal sectional view of the guiding drum according to FIG. 5.

In a third embodiment according to FIGS. 5 and 6, the ratio of the diameters of the guiding drum 1 to the adjacent impression cylinder 39 and 40 is four to two i.e. the central guiding drum 1 has four gripper bridges 5 which are divided symmetrically around the periphery of the drum 1. The adjacent impression cylinders 39 and 40 each have two gripper bridges corresponding to the ratio of diameters which are arranged diametrically opposite to one another but are not shown in FIG. 5.

The gripper support 8 of these gripper bridges 5 is suspended swingably about the gripper shaft 41 of the grippers 7. At each end of the gripper support 8, a double lever 43 is cast thereto and accommodates at one end thereof the bearing for a gripper shaft 41, and at its free end engages compression springs 42 which are supported on the gripper-bridge bracket 9. Depending upon the width of the drum, several double levers 43 and bearings, respectively, can be provided. The compression springs 42 press the gripper support 8 in a counterclockwise direction about the gripper shaft 41 so that the gripper support 8 inevitably rests on the free end of an adjusting screw 30.

As shown in FIG. 6, several adjusting screws 30 are provided at least in each end region of the gripper support 8. The screws 30 are screwed into respective threaded bores formed in a hollow shaft 45. The hollow shaft 45 is rotatably mounted in the outer wall 46 of the drum body 6. At the lower free end of this hollow shaft 45, as shown in FIG. 6, the latter is shaped as a bevel gear 47 which meshes with another bevel gear 48 mounted on the adjusting shaft 22. The adjusting screw 30 is prevented from turning by means of a clamping plate 57 located above the hollow shaft 45, in conjunction with the locking pin 58. The clamping plate 57 is tightened after the basic setting of the adjusting screws 30.

The adjusting shaft 22 is rotatably mounted in the end walls 16 of the drum 1. A free end of the adjusting shaft 22 carries the adjusting pinion 34 which is engaged with the adjusting disc 12. As shown in FIG. 5, an adjusting shaft 22 with its adjusting pinion 23 positively engaged with the adjusting disc 12 is assigned to each gripper bridge 5.

Only one adjusting disc 12 is provided for adjusting all four adjusting shafts 22. Again, it is rotatably arranged on the shaft shoulder 4 of the drum body 6 between the drum end wall 16 and the machine side-wall 15. The central adjusting device is assigned to each of the four adjusting shafts 22, and the free end of each of the four adjusting shafts 22 i.e. at the end at which the adjusting pinion 23 is secured, is constructed as an adjusting hexagon 36. By turning any adjusting hexagon head 36 with the aid of a wrench, all four gripper supports 8 are moved higher or lower to exactly the same extent via the adjusting pinion 23, the adjusting disc 12, the adjusting shafts 22, the bevel gear drives 47, 48 and the adjusting screws or bolts 30, the gripper supports 8 being swiveled about the gripper shaft 41 against or with the assistance of the force of the compression springs 42.

The embodiment of the invention shown in FIGS. 5 and 6 thus permits a basic setting of each gripper support 8, as well as common adjusting of all four gripper supports 8 by means of the central adjusting device 17.

The gripper support 8 according to the invention, as shown in FIG. 7, can also be mounted on a cantilever spring beam 49 which, as viewed from the gripper support 8, is secured, behind the gripper bridge 5, to the drum body 6 by means of bolts 29. The intrinsic resilience of this relatively rigid spring beam 49 is sufficient to continuously hold the underside thereof resting flush on one or more adjusting screws or bolts 30. The spring beam 49 is bent by adjusting the adjusting screws 30 vertically so that the gripper support 8 is adjusted in radial direction i.e. set higher or lower corresponding to the paper thickness to be processed.

In FIG. 8, instead of being mounted on a spring beam 49, the gripper support 8 is mounted on a pivot bearing 50 having bearing arms approximately corresponding to the length of the spring beam 49. As viewed from the gripper support 8, the pivot bearing 50 itself is therefore also arranged behind the gripper bridge 5 on the drum body 6. A tension spring 52 ensures that the gripper support 8 will always rest on the upper end of an adjusting screw or bolt 30. The operating principle of this gripper support arrangement is quite clear. By vertically adjusting the adjusting screws or bolts 30, the gripper support 8 is swiveled about the pivot bearing 50. This swivelling action serves the purpose of vertically adjusting the gripper support 8.

In FIGS. 9 and 10, a type of construction of the gripper support 8 is shown as it could be used in the aforedescribed embodiments. It permits linear alignment of the gripper support. The gripper support 8 is formed of an upper beam 59 and a lower beam 60 which are separated by the slot 25. Webs 56 at each end of the gripper support 8 mutually connect the two beams 59 and 60. Depending upon requirements, the beams 59 and 60 can have a selected thickness which is the same or different. Both beams 59 and 60 are mutually connected over the slot 25 by clamping bolts 53. A large number of these clamping bolts 53 can be arranged at regular intervals over the length of the gripper support 8. In the vicinity of each clamping bolt 53, the slot 25 is formed with a respective recess 54 in which a double clamping nut 55 is mounted, the clamping bolt 53 passing through the inner bore thereof. With the aid of the clamping bolts 53 in conjunction with the double clamping nuts 55, each individual gripper support or a region of the gripper support 8 can be vertically adjusted.

As mentioned hereinbefore, the invention is not limited to the described embodiments. For example, it is also conceivable to provide a motor drive for the central adjusting device 17, with the motor being controlled from the control panel or desk of the printing machine or a central control panel or desk for several printing machines. For this purpose, facilities must of course also be provided which feed back to the control panel the set position of the gripper supports 8.

The foregoing is a description corresponding, in substance, to German application No. P 34 28 668.3, dated Aug. 4, 1984, International priority of which is being claimed for the instant application, and which is hereby made part of this application. Any material discrepancies between the foregoing specification and the specification of the aforementioned corresponding German application are to be resolved in favor of the latter.

There is claimed:

1. Sheet-guiding drum for sheet-fed rotary printing machines, having a drum body carrying at least two gripper bridges adjustable to different paper thicknesses, comprising gripper supports carried by the drum, said gripper supports being adjustable in radial direction of the drum; play-free adjusting elements carried by the drum body and adjustable independently of one another for adjusting said gripper supports in respective radial directions to the thickness of respective paper sheets to be processed; and a central adjusting device mounted readily accessibly on the drum body for actuating said adjusting elements in common so as to adjust said gripper supports in common in the respective radial directions.

2. Sheet-guiding drum according to claim 1 wherein said gripper supports are radially adjustably held on the gripper bridges.

3. Sheet-guiding drum according to claim 1 wherein said gripper supports are arranged on a spring beam.

4. Sheet-guiding drum according to claim 1 including a shaft disposed on the drum and extending in axial direction thereof parallel to the rotational axis of the drum, said gripper supports being mounted on and swingable about said shaft.

5. Sheet-guiding drum according to claim 1 including two adjusting discs respectively disposed at end faces of the drum, and respective control arms connecting said adjusting discs and gripper supports, respectively, said gripper supports being adjustable by said adjusting discs in conjunction with said control arms.

6. Sheet-guiding drum according to claim 5 wherein each of said control arms is adjustable in length.

7. Sheet-guiding drum according to claim 1, wherein each of said gripper supports is constructed as a resilient clamping beam formed with a slot extending in longitudinal direction thereof and dividing said clamping beam into a thin flexible clamping rail and a rigid gripper support carrier, said gripper support being fastened by bolts to the drum body in a middle region of said clamping rail.

8. Sheet-guiding drum according to claim 7, wherein said central adjusting device is disposed at one of the end faces of the drum body, and including cam-bearing adjusting discs disposed at the end faces of the drum body and mutually connected by cross-pieces, said adjusting discs being actuatable by said central adjusting device via a worm drive, the cams of said adjusting discs being operatively engageable with ends of adjusting bolts threadedly received in both end regions of said gripper support.

9. Sheet-guiding drum according to claim 1 wherein said gripper supports are swingably mounted and are adjustable against spring bias by means of adjusting bolts.

10. Sheet-guiding drum according to claim 1 wherein said gripper supports are swingable about a bearing mounted on the drum body and disposed behind a gripper-carrying shaft of a respective gripper bridge, said bearing having a rotary axis extending parallel to said gripper-carrying shaft.

11. Sheet-guiding drum according to claim 1 wherein each of said gripper supports is formed as a beam having a longitudinal slot therein separating an upper beam member from a lower beam member, a plurality of clamping bolts mutually connecting the upper and the lower beam members across said slot and cooperating with double clamping nuts mounted on said clamping bolts and disposed in said slot for aligning the respective gripper support.

12. Sheet-guiding drum according to claim 1 comprising motor means connected to said central adjusting device for driving said device, and a control panel connected to said central adjusting device for controlling said central adjusting device.

13. Sheet-guiding drum for sheet-fed rotary printing machines, having a drum body carrying at least two gripper bridges adjustable to different paper thicknesses, comprising gripper supports carried by the drum, said gripper supports being adjustable in radial direction of the drum; play-free adjusting elements carried by the drum body and adjustable independently of one another for adjusting said gripper supports; a central adjusting device mounted readily accessibly on the drum body for actuating said adjusting elements in common, two adjusting discs respectively disposed at end faces of the drum, respective control arms connecting said adjusting discs and gripper supports, respectively, said gripper supports being adjustable by said adjusting discs in conjunction with said control arms, said central adjusting device being disposed in a middle region of one of the gripper bridges, and an adjusting shaft mounted on the drum and carrying respective adjusting pinions operatively engaging said adjusting discs, said adjusting shaft further carrying a worm drive in operative engagement with said central adjusting device, said adjusting discs being actuatable by sid central adjusting device via said worm drive, said adjusting shaft and said adjusting pinions.

* * * * *